US005820025A

United States Patent [19]

Troudt

[11] Patent Number: 5,820,025

[45] Date of Patent: Oct. 13, 1998

[54] REVERSIBLE SPRAY TIP HOLDER

[76] Inventor: Kevin J. Troudt, 6635 Devonshire Dr., Gladstone, Oreg. 97027

[21] Appl. No.: 821,161

[22] Filed: Mar. 20, 1997

[51] Int. Cl.[6] ..... B05B 15/02; B05B 1/28

[52] U.S. Cl. ..... 239/119; 239/106; 239/288.3; 239/532; 239/600

[58] Field of Search ..... 239/104, 106, 239/119, 288, 288.3, 288.5, 532, 600

[56] References Cited

U.S. PATENT DOCUMENTS

| | | | |
|---|---|---|---|
| 2,564,131 | 8/1951 | Greenspoon et al. | 239/119 |
| 2,743,959 | 5/1956 | Nelson et al. | 239/119 X |
| 4,074,857 | 2/1978 | Calder | 239/119 |
| 4,484,707 | 11/1984 | Calder | 239/119 |
| 4,513,913 | 4/1985 | Smith | 239/119 |
| 5,253,984 | 10/1993 | Gruett et al. | 239/119 X |

*Primary Examiner*—Andres Kashnikow
*Assistant Examiner*—Robin O. Evans
*Attorney, Agent, or Firm*—David L. Tingey

[57] ABSTRACT

A reversible spray tip holder for connection to a spray gun comprises a union with like quick-disconnect mounts on each of entry and exit ends for connecting to a mounting adaptor which facilitates connection to the spray gun. A base and a tip housing join by means of a base threaded bolt threaded into a matching tip housing threaded recess to comprise the union. In the tip housing is a tip receiver opening into the tip housing threaded recess on one end and extending to the tip housing exit end at its other end which is closed except for an aperture through which the tip receivable within sprays paint. A tip is received and sealed into the tip receiver, secured therein by the base threaded bolt, with a tip nozzle immediately adjacent to and directed through the aperture. A through passageway extends from the adaptor and spray gun through the base and tip housing to the spray tip. Diverging shields on the tip housing preserve an intended spray pattern. In operational mode, the entry end is connected to the adaptor. To quickly clean the spray, the union mount is reversed with the exit end connected to the adaptor.

13 Claims, 2 Drawing Sheets

REVERSIBLE SPRAY TIP HOLDER

BACKGROUND

1. Field of the Invention

This invention relates to pressurized spray devices, and, more specifically, to reversible spray tip holders adapted for mounting to spray guns.

2. Prior Art

It is commonly known that spray systems, typically paint spray guns, are frequently plugged as solid materials are introduced in the system, eventually clogging a spray tip or nozzle. Previously, to clean a clogged tip, the spray system was disassembled and the tip was cleaned before reassembly. The time and effort involved led to technology directed at reversing the orientation of the tip in the system without disassembly. Two orientation modes were made available: an operation mode for normal use and a cleaning mode for cleaning. In cleaning mode, the tip was reversed from its operational orientation so solid material was then blown out of the tip by the pressurized system the way it came in. The cleaned tip would then be returned to operational mode.

Difficulties have been encountered in available systems. Systems based on a rotatable turret holding the tip were difficult to turn because of the pressure required to obtain a satisfactory seal. This approach was unable to employ standard, low-cost tips, requiring more expensive custom tips tailored to the turret approach.

Another approach was a tip holder locked in a cylinder by bolt action. A variation was a removable bolt holding a tip that was removed, reversed in orientation for cleaning, and then again removed and placed in the cylinder in operational mode. These approaches also were also unable to employ standard, low-cost tips, requiring more expensive custom tips tailored to the turret approach. They also required some disassembly and manipulation of small parts difficult to manage.

The object of the present invention is to provide a spray tip holder reversible for cleaning without removal of the tip or its holder from the general housing. It is a another object that the holder accommodate inexpensive spray tips of various sizes. It is a further object that the system fully seal against paint leakage both during use and during cleaning modes. It is yet another object that the system prevent spitting caused by air vortices between spray tip and the spray system discharge end.

SUMMARY

This objects are achieved in a spray tip system providing an adaptor for connection to a spray gun and a union with like quick-disconnect mounts on each of entry and exit ends connecting to the adaptor. In operational mode, the entry end is connected to the adaptor; in cleaning mode, the exit end is connected to the adaptor.

The union further comprises a base connected to the adaptor during operational mode and a tip housing connected to the base in the cleaning configuration. During cleaning mode the base is disconnected and the tip housing is connected to the adaptor. The base is connected to the tip housing to form a union by means of a threaded bolt threaded into a matching threaded recess in the tip housing.

In the tip housing is a tip receiver opening into the tip housing threaded recess on one end and extending to the tip housing exit end at its other end which is closed except an aperture through which the tip receivable within sprays paint. A tip is received into the tip receiver with its tip nozzle immediately adjacent to and directed through the aperture. Thus vortices are eliminated that might otherwise occur between the tip received in the tip receiver and the housing exit end. A resilient sealing ring, typically of "O-ring" design, is installed in the recess over the tip. Tips are secured in the tip receiver by the base threaded bolt tightened until the ring under compression seals the bolt at the tip. Tips of variable size are accommodated by adjusting the extent the bolt is threaded into the recess. A ring support extends axially from the bolt, sized to fit within and partially through the ring to prevent the ring from collapsing inwardly during compression against the tip.

A through passageway extends from the adaptor connection to a spray gun through the adaptor, the base, and the tip housing to the spray tip through which paint passes.

The tip housing further comprises shields diverging from the exit end to preserve an intended spray pattern and to also protect the user from unexpected paint discharges. The adaptor is elongated sufficiently to maintain the shields between the tip housing exit end and the adaptor connection to the spray gun.

The like quick-disconnect mounts on both the base and the tip housing comprise a threaded recess matching external threads on the adaptor. To accommodate the tip receiver extending into the tip housing recess, the adaptor is provided with a recess at the externally-threaded end to receive the tip receiver. The through passageway in the adaptor ends at said adaptor recess, sealed by a sealing ring. To maintain a like seal during operational mode when the base is connected to the adaptor, a base lug simulating the tip receiver is provided in the base threaded recess, similarly extending into the adaptor recess..

DETAILED DESCRIPTION OF THE PREFERRED EMBODIMENT

Figure 1:
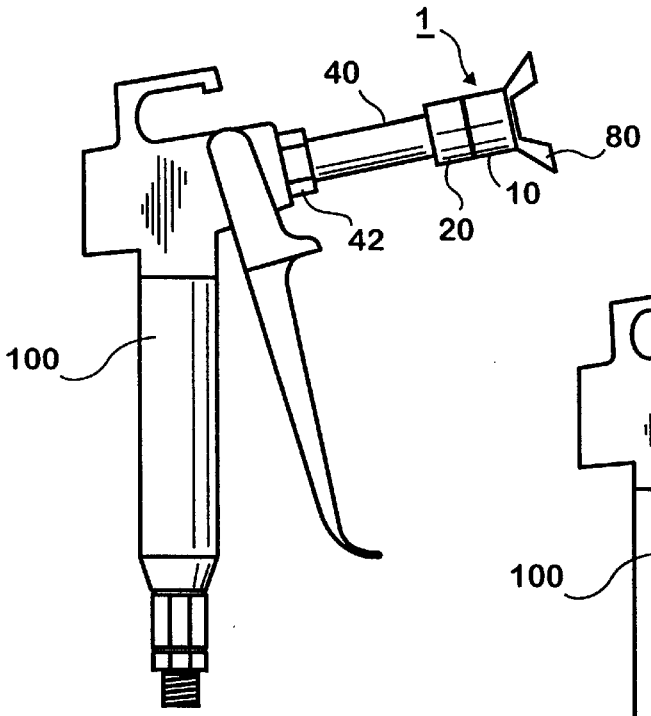
FIG. 1 is a side pictorial view of a representative spray gun with the spray tip holder of the present invention attached in operational mode.
Figure 2:
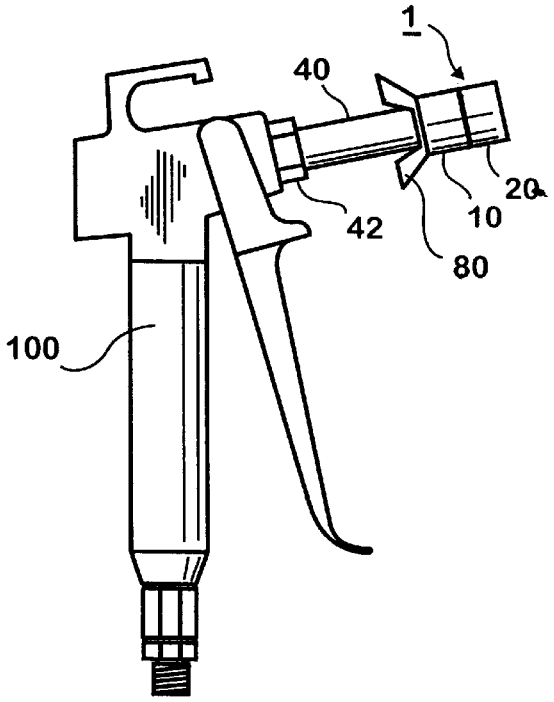
FIG. 2 is a side pictorial view of a representative spray gun with the spray tip holder of the present invention attached in cleaning mode.
Figure 3:
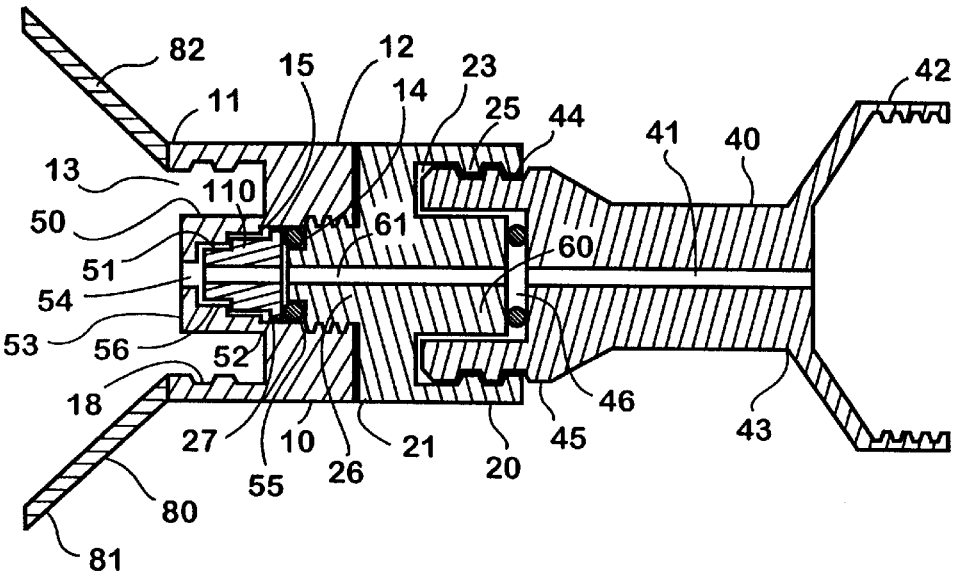
FIG. 3 is a side sectional view of the spray tip holder.
Figure 4:
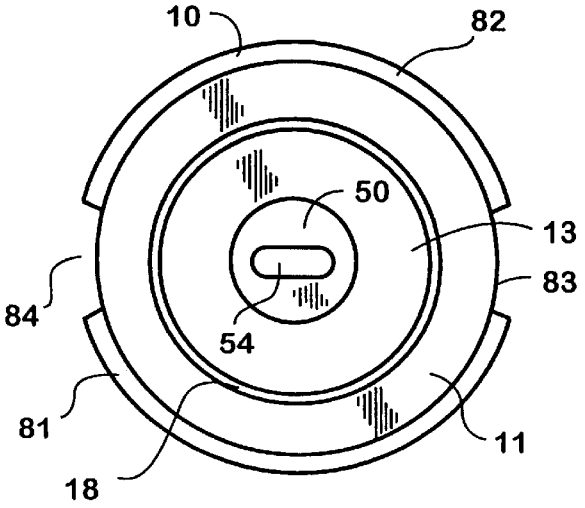
FIG. 4 is a exit end view of the tip housing.
Figure 5:
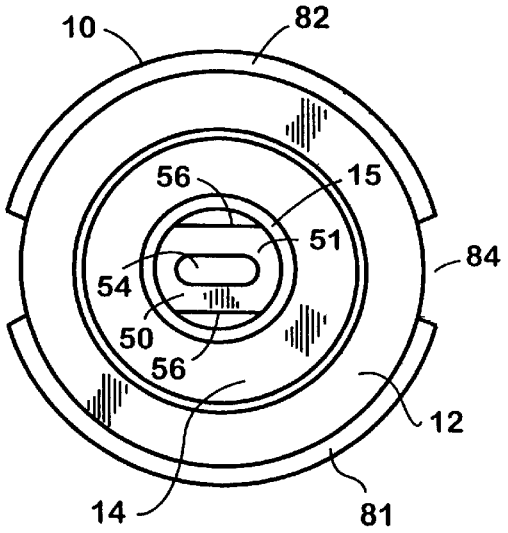
FIG. 5 is a joinder end view of the tip housing.
Figure 7:
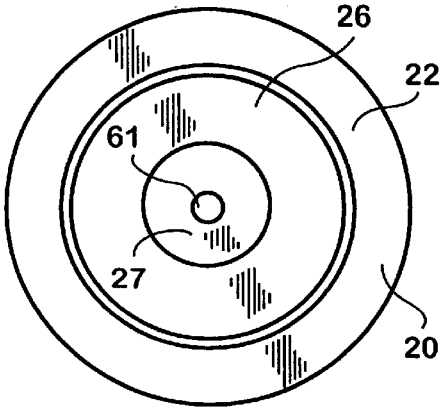
FIG. 7 is a joinder end view of the base.
Figure 6:
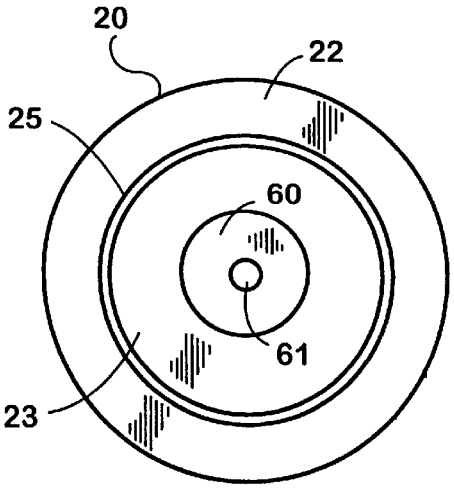
FIG. 6 is a entry end view of the base.
Figure 8:
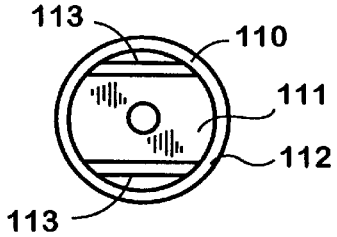
FIG. 8 is a spray end view of a typical spray tip.

Referring to the figures, the spray tip holder of the present invention comprises a tip housing 10 with an exit end 11 and a joinder end 12, a base 20 with a joinder end 21 and an entry end 22, and an adaptor 40 to facilitate mounting of the holder to a spray gun 100. The tip housing and the base join together at their joinder ends to form a union 30 which presents symmetric mounting means on each end. The union can then be selectively mounted to the adaptor at either the base entry end or the tip housing exit end which also define the union ends.

The adaptor 40 is elongate with a hole 41 through which paint or other fluid can pass from a pressurized source, such as the spray gun 100. To mount the adaptor 40 to the spray gun 100, a mounting nut 42 is provided on the adaptor gun end 43, sized to match external threads commonly provided on conventional spray guns with the hole opening into the nut along the nut axis. The adaptor 40 also includes external threads 44 on the end 45 opposite the gun end 43, referred to as the union end. The adapter 40 further includes a recess 46 in the union end 45 adapted to selectively receive a lug 60 or a tip receiver 50 as the tip housing 10 or the base 20 is removably mounted in the adaptor union end 45.

The tip housing 10 includes a threaded recess 13 on the exit end with threads 18 matching adaptor external threads 44 adapted to selectively mount the tip housing 10 removably to the adaptor 40. A threaded recess 14 is also provided in the joinder end 12, adapted to receive the base 20. The tip receiver 50 includes a cavity 51 adapted to receive a spray tip 110 therein which opens into the joinder end recess 14 at one end 52 and extends into the exit end threaded recess 13 to the tip housing exit end 11 at its other, closed end 53. The tip receiver 50 has an aperture 54 on its tip housing exit end 11 through which fluid can pass from the cavity 51 or a spray tip received therein, spraying from the housing exit end 11. To accommodate a spray tip that produces a horizontal spray pattern, the tip receiver aperture 54 is oblong.

The tip housing 10 also includes a ledge 15 between the tip receiver cavity 51 and the joinder end recess 13, the cavity 51 being smaller than the recess 13 and sized to receive a spray tip 110. A typical tip has a body 111 with a support shoulder 112 such that when placed in the tip receiver50, the tip body 111 fits in the tip receiver cavity 51 and is supported on the ledge 15 by the support shoulder 112. A resilient tip receiver sealing ring 55, typically of common "O-ring design, sized to match the joinder end recess 14 is placed over the tip 110 to seal the tip in the tip receiver 50.

The typical tip also has alignment sides 113. Alignment guides 56 are therefore provided in the tip receiver cavity 51 disposed to align said tip receivable therein such that for a tip adapted to produce a horizontal spray pattern, said pattern aligns with the oblong aperture 54 of the tip receiver 50 with the guides 56 matching the sides of said receivable tip.

The base 20 comprises a threaded recess 23 on its entry end 22 with threads 25 matching adaptor external threads 44 adapted to selectively mount the base 20 removably to the adaptor 40. The base 20 also includes a threaded base bolt 26 on its joinder end 21 matching the tip housing joinder end threaded recess 14 thus connecting base 20 to the tip housing 10 form the union 30. The bolt also secures the spray tip 110 in the recess-extending cavity 51.

A base ring support 27 extends from the base bolt 26, the support sized such that the tip receiver sealing ring 55 surrounds the ring support 27 with the support extending partially through the ring such that when the base 20 and tip housing 10 are connected together, the base bolt 26 compresses and seals the ring 55 against said tip support shoulder receivable therein, the ring support 27 preserving an inner ring diameter.

The base, bolt and ring support also have an orifice 61 through which fluid can pass. The hole 41 and orifice 61 are disposed in alignment with the spray tip 50 to present a through passageway from the spray gun through the spray tip holder.

The base 20 further includes a lug 60 in its entry end recess 23, replicating the tip receiver 50 in the tip housing exit end recess 13. When either the tip receiver or the base lug extends into the adaptor recess 45 as the tip housing or the base, respectively, is mounted to the adaptor, the tip receiver or base lug fits sealably against the adaptor recess end. A sealing ring in the adaptor union end recess 45, typically of the common "O-ring" design, provides a seal as either the base lug or the tip housing tip receiver is mounted in the adaptor.

The spray tip holder further comprises tip housing shields 80 diverging from the tip housing exit end 11 to shield a spray pattern produced by fluid sprayed from a tip 110 in the tip receiver 50. Said shields comprise spaced-apart upper and lower shield members 81 and 82 on a tip housing circumference 83 forming a channel 84 therebetween through which said horizontal spray pattern can pass. To accommodate said tip housing shields, the adapter 40 is elongated of sufficient length such that the shields 80 are between the adaptor connecting nut 42 and the tip housing exit end 11 when the tip housing 10 is mounted to the adaptor 40.

I claim:

1. A spray tip holder for mounting to a spray gun comprising an elongate adaptor with a hole therethrough including means on a gun end for mounting the adaptor to a spray gun such that fluid from the spray gun passes through the hole, and an union mounting means on a union end opposite the gun end, a tip housing having an exit end and a joinder end having a recess, including a housing mounting means on the tip housing exit end adapted to removably mount to the union mounting means of the adaptor, a tip receiver having a recess-extending cavity open to the joinder end through the recess adapted to receive a spray tip therein, the tip receiver having an aperture through which fluid can pass from the cavity or the tip received therein, spraying from the housing exit end, a base having a joinder end and an entry end and including a base mounting means on the entry end also adapted to removably mount to the union mounting means of the adaptor, and a base bolt adapted to fit in the tip housing recess to secure said spray tip receivable in the recess-extending cavity, the base and a lug having an orifice through which fluid can pass, the adaptor hole and base and lug orifice disposed in alignment with said tip receivable in the tip receiver to present a through passageway from the spray gun through the spray tip holder, means for removably joining the tip housing joinder end to the base joinder end forming a union, the union thereby presenting symmetric mounting means on each end such that the union can be selectively mounted to the adaptor at either the base entry end or the tip housing exit end comprising the union ends.

2. The spray tip holder of claim 1 in which the union mounting means of the adaptor comprises an externally-threaded union end, and the mounting means of both the base and the tip housing adapted to mount to the union mounting means of the adaptor comprise matching internally-threaded adaptor-mount recesses on said base entry end and said tip housing exit end, respectively.

3. The spray tip holder of claim 2 in which the adaptor has a recess having an internally-threaded recess wall and a recess end in the adaptor union end for removably receiving the lug in the base entry end or the tip receiver in the tip housing exit end, selectively, and said tip receiver extends in said tip housing adaptor-mount recess such that when said tip housing exit end is mounted to said adaptor union end, the tip receiver fits sealably against the adaptor recess end, and said base mount includes the lug that extends in said base adaptor-mount recess such that when said base entry end is mounted to said adaptor union end, the base lug fits sealably against the adaptor recess end.

4. The spray tip holder of claim 3 in which the tip receiver extends in the adaptor-mount recess to the tip housing exit end.

5. The spray tip holder of claim 1 in which the means for removably joining the tip housing joinder end to the base joinder end comprises said tip housing having a second threaded recess on a joinder end, and said base including the threaded bolt on a joinder end threaded into the tip housing joinder end threaded recess, said bolt extending to the tip receiver adapted to secure a tip within.

6. The spray tip holder of claim 3 further comprising means for sealing the union ends in the adaptor.

7. The spray tip holder of claim 6 in which the means for sealing the union ends in the adaptor comprises a sealing ring in the adapter union end recess sealing against the base lug or the tip housing tip receiver.

8. The spray tip holder of claim 1 further comprising a ledge between the tip receiver cavity and the joinder end recess, the cavity being smaller than the recess, sized to receive the tip having a body with a support shoulder such that the tip body fits in the tip receiver cavity supported on the ledge by the support shoulder, a resilient tip receiver sealing ring sized to match the joinder end recess, a ring support extending from the base lug with the lug orifice passing therethrough, the support sized such that the ring surrounds the ring support with the support extending partially through the ring such that when the base and tip housing are connected together, the base lug seals the ring against said tip shoulder receivable therein, the ring support preserving an inner ring diameter.

9. The spray tip holder of claim 1 further comprising tip housing shields diverging from the tip housing exit end to shield a spray pattern produced by fluid sprayed from a tip in the tip receiver.

10. The spray tip holder of claim 9 in which the tip receiver aperture is oblong to accommodate said tip receivable in the tip receiver that produces a horizontal spray pattern, and said shields further comprise spaced-apart upper and lower shield members on a tip housing circumference forming a channel therebetween through which said horizontal spray pattern can pass.

11. The spray tip holder of claim 9 in which said adapter is elongated of length sufficient to accommodate said tip housing shields between the adaptor means for mounting the adaptor to a spray gun and the tip housing mounting means when the tip housing is mounted to the adaptor.

12. The spray tip holder of claim 10 in which the tip receiver further comprises guides in the tip receiver cavity disposed to align said tip receivable therein such that for a tip adapted to produce a horizontal spray pattern, said pattern aligns with oblong aperture of the tip receiver with the guides matching sides of said receivable tip.

13. A spray tip holder comprising a tip housing with a first threaded recess on a first, or exit, end and with a second threaded recess on a second, or joinder, end and including a tip receiver in the second recess having a cavity open to the joinder end for receiving a tip therein, the tip receiver extending into the first threaded recess and having an orifice through which fluid can pass from the cavity or said tip receivable therein, spraying from the housing exit end, a base with a first threaded recess on a first, or entry, end and including a threaded bolt on a second, or joinder end with threads matching the threaded recess of the tip housing joinder end, the tip housing and the base connected together by means of the bolt threaded into the recess of the tip housing joinder end to form a union, the base further including on the entry end a lug extending into the entry end threaded recess in like manner and dimension as the tip receiver extends into the tip housing first threaded recess and likewise having an orifice through which fluid can pass from the base entry end into the tip receiver cavity, the union thereby presenting symmetric mounting means with base lug or tip receiver at the entry and exit ends, respectively, an elongate adaptor with an axial hole therethrough including means on a gun end for removably mounting the adaptor to a spray gun such that fluid from the spray gun passes through the axial hole and further including a threaded union end opposite the gun end, the threads matching those of the base entry end and the tip housing exit end, the adapter further having a recess in the union end adapted to selectively receive the tip receiver or the base second lug as a union exit or entry end is removably mounted in the adaptor union end.

* * * * *